United States Patent [19]

Kramer

[11] Patent Number: 4,790,357

[45] Date of Patent: Dec. 13, 1988

[54] HARNESS FRAME SLAT AND HEDDLE

[75] Inventor: Charles F. Kramer, Greenville, S.C.

[73] Assignee: Steel Heddle Mfg., Inc., Greenville, S.C.

[21] Appl. No.: 82,803

[22] Filed: Aug. 6, 1987

[51] Int. Cl.[4] ..... D03C 9/04

[52] U.S. Cl. ..... 139/91; 139/96

[58] Field of Search ..... 139/91, 92, 93, 94, 139/95, 96

[56] References Cited

U.S. PATENT DOCUMENTS

| | | | |
|---|---|---|---|
| 3,071,164 | 1/1963 | Nussbaum | 139/92 |
| 3,862,650 | 1/1975 | Porter | 139/91 |
| 4,492,256 | 1/1985 | Kramer | 139/92 |
| 4,519,424 | 5/1985 | Ishido et al. | 139/91 |

FOREIGN PATENT DOCUMENTS

| | | | |
|---|---|---|---|
| 918020 | 9/1954 | Fed. Rep. of Germany | 139/92 |

*Primary Examiner*—Henry S. Jaudon

*Attorney, Agent, or Firm*—Dority & Manning

[57] ABSTRACT

A heddle frame assembly for a weaving machine comprising elongated top and bottom slats supported at each end by side members. Each of the top and bottom slats includes a symmetrically depending heddle support bar at one of its edges. The heddle support bar includes opposed heddle support surfaces which lie in intersecting planes which intersect with a vertical plane taken through the longitudinal axis of the slat at a point which is between said heddle support surface and the free end of the heddle bar.

21 Claims, 4 Drawing Sheets

HARNESS FRAME SLAT AND HEDDLE

BACKGROUND OF THE INVENTION

This invention relates to the construction for a heddle frame which includes top and bottom frame slats, each of which has a heddle rod integral therewith, or attached thereto, which supports heddles in the frame. The heddles include central thread eyes in which the individual warp yarn ends are held during shedding operations on the loom. The heddles are typically constructed of metal and are attached to the heddle rod by means of U-shaped slots in which the heddle rod is received.

The majority of the high-speed weaving machines, in use presently in the textile industry, provides for a 12 mm. space for each harness frame. Each frame in the set of frames is actuated by levers and cams all in side by side relationship. One or more of fixed nose guides on each frame, having a thickness essentially equal to the 12 mm. pitch between the center lines of the frames, serve to keep the thinner (generally 9 mm.) harness slats from clashing together.

Manufacturers of high-speed weaving machines recognize that the stroke of the shed opening could be reduced and the weaving machine speed increased if the pitch of the harness frames could be reduced to 10 mm. or less. Unfortunately, the currently popular asymmetrical riveted rod construction is not practical from clearance and strength standpoints when all dimensions of the slats are simply reduced.

A typical slat in use currently is shown in U.S. Pat. No. 4,633,916, issued Jan. 6, 1987 to John L. Rast and owned by the assignee of the present application. The slat disclosed in this patent greatly reduced the weight of the heddle frames and thereby led to increases in the weaving machine speeds because of the reduced weight. However, the problem arises that the asymmetrical slat disclosed in this patent still requires a greater pitch due to clearance and strength limitations, than a symmetrical slat according to the present invention.

Accordingly, an important object of the present invention is to provide a heddle frame assembly having a heddle slat which can be reduced in thickness without weakening the structure of the frame.

It is another object of the invention to provide a heddle frame slat which has a heddle support bar that is symmetrical.

It is still another important object of the invention to provide a heddle with symmetrical U-shaped open ends for engaging the heddle bar and avoiding accidental disengagement therefrom.

SUMMARY OF THE INVENTION

The above objects are accomplished according to the present invention by providing a heddle frame assembly for a loom which utilizes a frame slat at the top and bottom of a generally hollow rectangular nature having along one of its longitudinal edges, either integral therewith or attached thereto, a heddle bar for supporting heddles. The vertical longitudinal axis of the slat extends also through the axis of the heddle support bar so as to produce a completely symmetrical frame slat.

Extending from each side of the heddle support bar are opposed heddle support surfaces which are wear-resistant and adapted to engage hook portions of the heddle. The invention also includes a heddle having a U-shaped open end with two extending arms terminating in inwardly converging hooks for engaging outwardly diverging heddle support surfaces of said heddle bar for retaining the heddles on said bar.

BRIEF DESCRIPTION OF THE DRAWINGS

The construction designed to carry out the invention will hereinafter be described, together with other features thereof.

The invention will be more readily understood from a reading of the following specification, and by reference to the accompanying drawings forming a part thereof, wherein examples of the invention are shown, and wherein.

DETAILED DESCRIPTION OF THE INVENTION

The invention relates to a vertically reciprocating heddle frame assembly on a weaving machine which holds the warp ends and raises and lowers the warp ends during shedding. Since the structural and operational features of weaving machines are well known, only so much of the weaving machine and heddle frame assembly is illustrated as is necessary for an understanding of the present invention.

Figure 1:
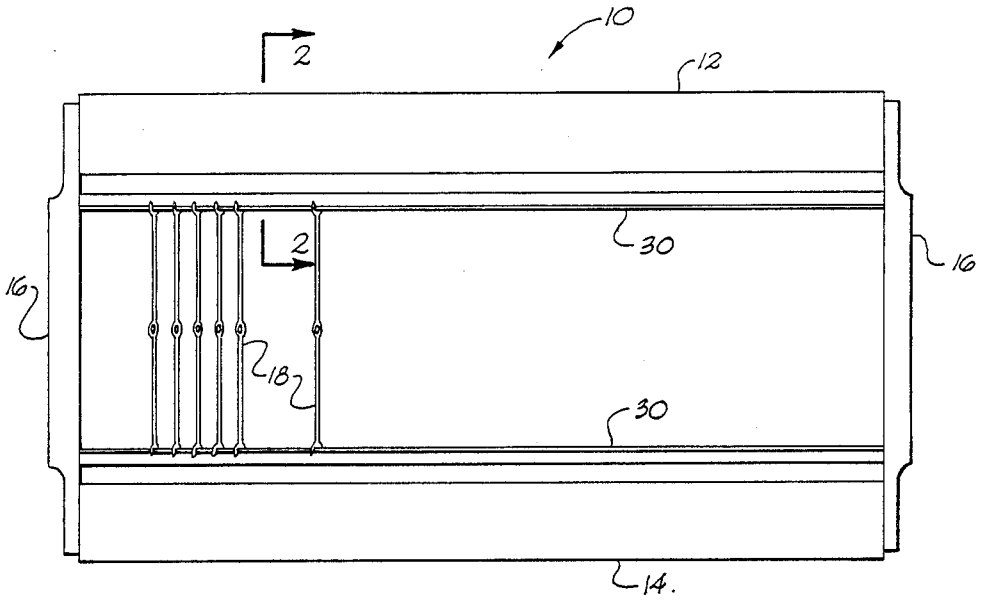
FIG. 1 is a front elevation illustrating a heddle frame assembly for a loom having frame slats and heddles constructed according to the instant invention.
Figure 2:
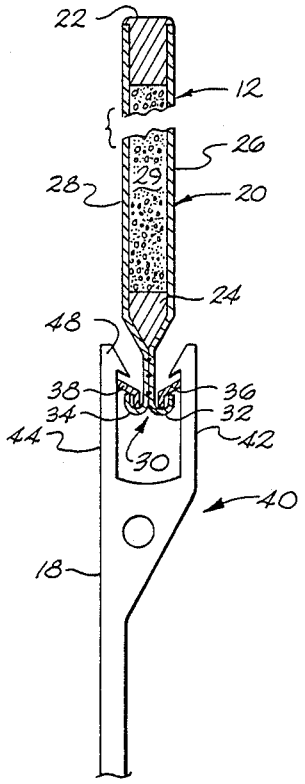
FIG. 2 is a sectional view taken along lines 2—2 of FIG. 1.
Figure 3:
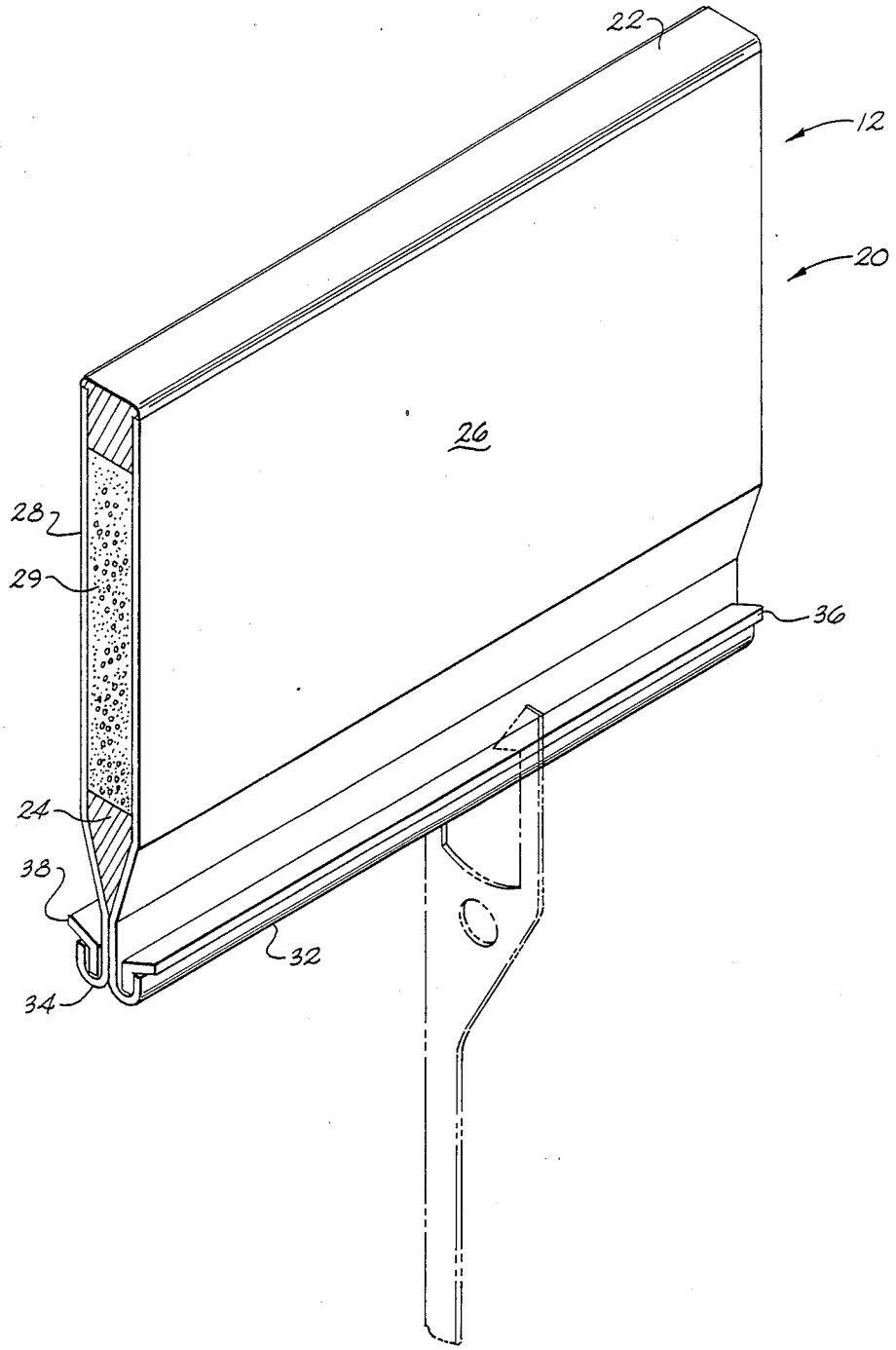
FIG. 3 is a perspective view of the upper slat shown in FIG. 2.

Referring now to FIGS. 1, 2, and 3 of the drawings, a heddle frame is designed generally as 10 in FIG. 1 and includes top frame slat 12 and bottom frame slat 14, which are identical in construction. The frame assembly also includes side frame members 16 which connect the top and bottom slats and maintains them in a parallel spaced position. Each of the top and bottom slats also includes a heddle support bar 30 and the frame assembly comprises a plurality of open-ended heddles 18 which extend between the heddle bars of the heddle frame assembly.

As pointed out above, each of the frame slats are identical and FIGS. 2 and 3, while showing the construction of the top frame slat and its relationship with the open end heddle, is intended to illustrate the frame slats used in the top and the bottom of the heddle frame assembly seen in FIG. 1. Referring now more particularly to FIGS. 2 and 3 wherein is shown top slat 12 which comprises a rectangular portion 20. Rectangular portion 20 comprises a cap outer 22 constructed of a pultrusion of resin reinforced by carbon fiber for adding rigidity and strength to the frame slat. A lower inner reinforcing pultrusion 24 is provided at the opposite longitudinal edge of the frame slat for stiffening and reinforcing the slat. In this embodiment, the front wall 26, composed of sheet steel or other rigid material, bridges the space between cap 22 and the lower pultrusion 24 and is bonded to both 22 and 24 by an epoxy glue or the like as may be suitable to the material selected.

A rear wall 28 also bridges the space between the cap 22 and lower pultrusion 24 of the frame slat. Interposed between cap 22 and lower pultrusion 24 and front wall 26 and rear wall 28 is a filler 29 which may be comprised of foam or a nylon honeycomb structure such as that illustrated in U.S. Pat. No. 4,633,916, identified above. The filler material is lightweight in construction yet renders the slat rigid in use.

The front and rear walls 26 and 28 extend beyond the lower edge of the slat to form a heddle support bar 30. The heddle support bar comprises J-shaped extensions 32 and 34 of each of the front and rear walls. The walls 26 and 28 are bonded together at 31 by means of spot welding, adhesive, or the like. Fitted within the J-shaped extensions 32 and 34 are angled front wear-resistant heddle support element 36 and rear wear-resistant heddle support element 38, respectively. Support elements 36 and 38 are securely retained within the U-shaped portions of the wall extensions by means of thermoplastic glue or interference fit but can be replaced whenever they wear out. A vertical plane extending along the longitudinal axis of slat 12 also extends to the longitudinal axis of the heddle support bar 30 as seen in FIG. 2.

Disposed on heddle support bar 30 is a plurality of open-end heddles 18 which are typically constructed of metal and include central thread eyes through which individual warp yarns are drawn and held during shedding on the weaving machine. Each end of heddle 18 is provided with a U-shaped opening 40. U-shaped opening 40 comprises vertically extending front arm 42 and rear arm 44 which terminate at their free ends in front hook 46 and rear hook 48. As seen in FIG. 2, the heddle supporting surface of the front and rear wear-resistant heddle supports 36 and 38 are angled so that their heddle supporting surfaces extend in planes which intersect each other and which also intersect the longitudinal vertical plane taken through the longitudinal axis of the slat and the heddle support bar. The planes of supports 36 and 38 diverge from the vertical plane towards the rectangular portion of the slat. The surfaces of hooks 46 and 48 where they contact the heddle supports 36 and 38 extends in planes which intersect each other and which intersect the vertical plane taken through the slat 12. This surface mates with the heddle support surfaces so that a downward force applied to heddle 18 causes hooks 46 and 48 to be cammed towards the vertical plane so as to retain the heddle on the heddle bar and to avoid accidental disengagement of the heddle therefrom.

It is to be noted that the thickness of slat 12 can be greatly reduced from what was possible with the prior art slat because of the symmetrical construction of the slat and the heddles herein. A thickness of 6.6 mm. for the slat has been found to be adequate to permit a 9 mm. pitch of the weaving machine. As pointed out above, this enables the manufacturer of the weaving machine to produce machines which will permit greater operating speeds thereof.

Figure 4:
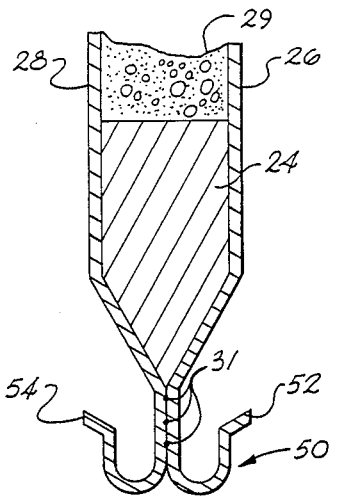
FIG. 4 is a partial sectional view similar to that shown in FIG. 2, illustrating a second embodiment of the heddle bar construction of the invention.
Figure 8:
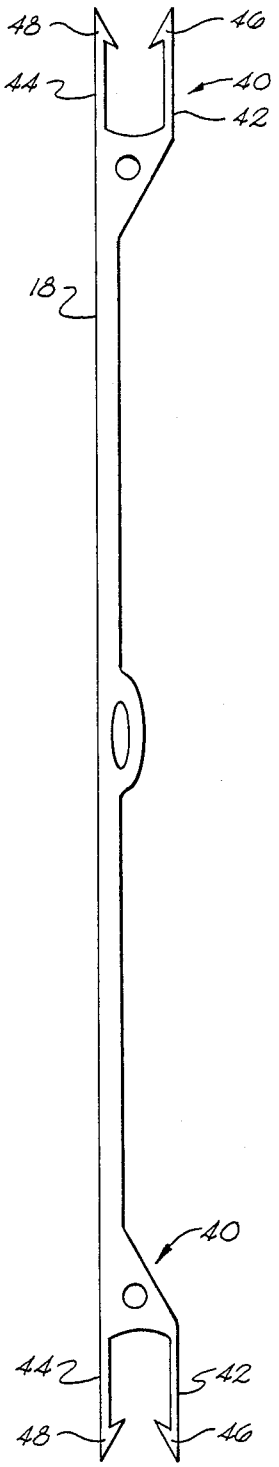
FIG. 8 is an elevation view of the heddle of the invention.

Referring now to FIG. 4 where a second embodiment of the heddle support bar is shown. In this embodiment, the heddle support bar is formed from the folded ends of walls 26 and 28 into a heddle support bar 50 which has a front heddle support surface 52 and a rear heddle support surface 54. Support surfaces 52 and 54 in this embodiment are hardened to make them wear resistant at the point where the hooks of the heddles 18 come into contact with them. In this embodiment, the surfaces of 52 and 54 lie in planes that intersect with each other and with the vertical plane extending through the vertical axis of the slat. The planes of surfaces 52 and 54 diverge in the direction of the slat rectangular portion and converge to intersect the vertical plane passing through the vertical axis of the slat at a point between the free end of the heddle bar and the point of contact with the heddle itself. In this embodiment, the same heddle disclosed in FIG. 2 and shown in FIG. 8 is used and its hook surfaces conform with the surfaces of 52 and 54.

Figure 5:
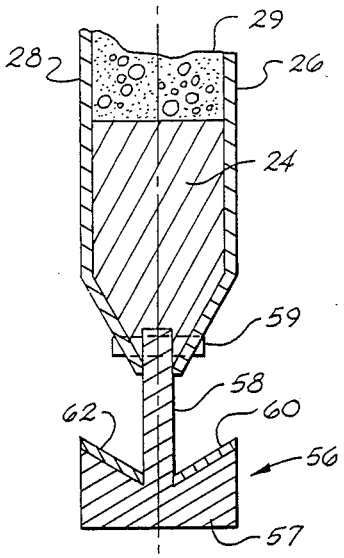
FIG. 5 is a sectional view similar to FIG. 4 illustrating a third embodiment of the heddle bar of the invention.

Reference now is had to FIG. 5 wherein a third embodiment of the slat is illustrated. In this embodiment, walls 26 and 28 terminate adjacent to the pultrusion 24 and heddle support bar 56 is formed of an extruded T-shaped piece of aluminum to which are bonded wear-resistant front heddle support 60 and rear heddle support 62. The leg of the vertical bar of the T-shaped extruded aluminum foot 57 is connected to slat 12 by means of a rivet or the like 59 it being understood that a plurality of rivets would be extending through the vertical leg of the T and the walls 26 and 28 all along the longitudinal edge of the slat and that the vertical leg of the T would extend into a groove or notch within pultrusion 24 in this embodiment. In this embodiment, heddle support surfaces 60 and 62 are wear-resistant and are bonded or glued to the surface of foot 57 by appropriate means. The support surfaces 60 and 62 lie in planes that intersect each other and that intersect a vertical plane extending longitudinally of the slat through the vertical axis of the slat and the vertical axis of foot 57 so as to intersect the vertical plane at a point which is closer to the end of bar 56 than it is to where such surfaces contact the hooks of heddle 18.

Figure 6:
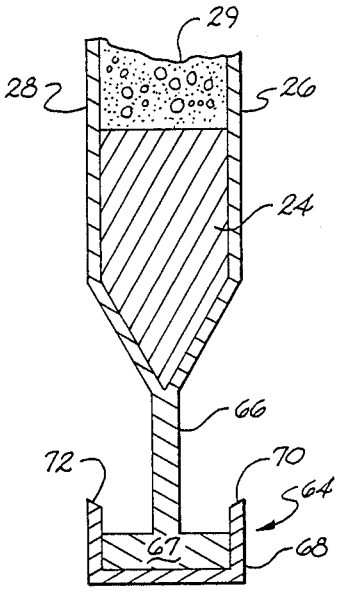
FIG. 6 is a sectional view similar to FIG. 4 showing a fourth embodiment of a heddle bar according to the invention.

Referring now to FIG. 6 wherein a fourth embodiment of the invention is illustrated. In this embodiment, heddle support bar 64 comprises an extruded aluminum extension bar foot 67 which is extruded integrally with walls 26 and 28. In this embodiment, the heddle support bar foot 67 is square and has attached to it a U-shaped heddle support composed of wear-resistant surfaces 70 and 72 which are cut at an angle for supporting the heddle hooks 46 and 48. Surfaces 70 and 72 lie in planes which intersect the longitudinal vertical plane of the slat at a point between the end of the heddle bar 64 and the point the heddle hooks contact said heddle supporting surfaces 70 and 72.

Figure 7:
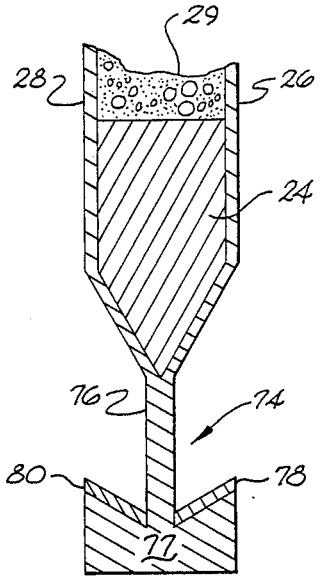
FIG. 7 is a sectional view of a fifth embodiment of the heddle bar according to the invention.

Referring now to FIG. 7 wherein a fifth embodiment of the heddle support bar is illustrated. In this embodiment, heddle support bar 74 comprises an extension 76 of the slat and a foot 77 which is T-shaped and integral with walls 26 and 28 of the slat. Walls 26 and 28 and T-extension 76 and 77 are all integrally extruded from aluminum. Disposed on the upper surfaces of foot 77 are front heddle support 78 and rear heddle support 80. The front and rear heddle supports are composed of a wear-resistant, case hardened metal which is bonded or spot welded to the foot 77. The surfaces of support 78 and 80 lie in planes which intersect each other and also the vertical plane extending along the vertical axis of heddle support bar 74 and slat 12 at a point which is closer to the free end of the heddle support bar than the point at which the heddle contacts the support surfaces.

Referring now to FIG. 8 wherein the heddle of the invention is illustrated. Heddle 18, as shown, has an open end 40 on each end of the heddle and arms 42 and 44 which terminate in hooks 46 and 48 for engaging the heddle bars of the invention.

While several embodiments of the invention have been described using specific terms, such description is for illustrative purposes, and it is to be understood that changes and variations may be made therein without departing from the spirit and the scope of the following claims.

What is claimed is:

1. A heddle frame assembly for a weaving machine, comprising:

(a) elongated top and bottom frame slats, each of which includes:

(1) a generally rectangular portion extending horizontally of said frame, having a front and rear wall of thin metallic materials affixed to an upper protrusion cap and a lower protrusion element to form a rigid, hollow, rectangular body, said walls being integral below the lower protrusion element to conform to a vertical plane which extends through the longitudinal axis of said rectangular portion, and terminates in a heddle support bar portion extending from, and along a longitudinal edge from said slat, said heddle support bar portion having heddle supporting surfaces extending from said bar on each side of said vertical plane, disposed in planes which intersect each other and said vertical plane at a point between the upper end of said heddle supporting surface and the free end of said heddle support bar;

(b) side members for maintaining said upper and lower slats in spaced substantially parallel relation to each other with said heddle bar portions disposed along adjacent longitudinal edges of said top and bottom slats; and (c) a plurality of elongated heddles extending between said upper and lower slats supported at each end by the heddle support bars on said slats, each of said heddles having an elongated body and a generally U-shaped opening at each of its ends, each of said U-shaped openings comprising two spaced longitudinal arms, each of which terminates in a hook having a support surface inclined towards the bottom of said U-shaped opening which lies in a plane which conforms to the plane of its supporting surface, whereby force exerted along the longitudinal axis of said heddle, away from the support bar, cams each of said longitudinal arms towards the longitudinal axis of the heddle supporting bar.

2. A heddle frame assembly as set forth in claim 1, wherein said front and rear walls are united to form said heddle support bar portion.

3. A heddle frame assembly as set forth in claim 1, wherein said heddle support bar portion comprises a generally T-shaped extruded member integral with said rectangular portion of said slat and has two hardened wear-resistant heddle supporting surfaces disposed on said bar.

4. A heddle frame assembly as set forth in claim 3, wherein said heddle supporting surfaces are formed by a U-shaped hardened wear-resistant element attached to said heddle support bar.

5. A heddle frame assembly as set forth in claim 3, wherein said heddle supporting surfaces are hardened wear-resistant material attached to the underside of the cross bar on the T-shaped portion of said heddle support bar.

6. A heddle frame assembly as set forth in claim 3, wherein said heddle support bar is extruded integrally with said rectangular portion of said slat.

7. A heddle frame assembly as set forth in claim 3, wherein said heddle support bar portion is extruded separately from said rectangular portion of said slat and attached to said slat by mechanical means.

8. A heddle frame assembly as set forth in claim 7, wherein said heddle support bar portion is attached to said rectangular portion of said slat by means of rivets.

9. In a heddle frame assembly for a weaving machine having elongated top and bottom frame slat each of which comprises:

(a) front and rear walls of sheet steel, a first portion of which are spaced from, and parallel to, each other; a second portion of which converges to a vertical plane taken between said first portions and an equal distance from each of said portions, said plane being parallel to said first portions; a third portion wherein said front and rear walls extend in abutting contact on opposite sides of said vertical plane and wherein said walls are attached to each other; and a fourth portion wherein each of said front and rear walls curve away from each other and from said vertical plane to form opposed upwardly and outwardly extending hook portions;

(b) a first pultrusion disposed between the edges of said front and rear walls in said first portion;

(c) a second pultrusion disposed between the second portions of said front and rear walls;

(d) filler means disposed between said first and second pultrusions and between the first portions of said front and rear walls, for imparting rigidity to said slat; and (e) heddle supporting surfaces, disposed within said opposed hook portions and each having a surface which lies in a plane which intersects the plane of the opposite surface and said vertical plane at a point between the edge of said fourth portion of said front and rear walls to form a heddle support bar.

10. In a heddle frame assembly as set forth in claim 9, wherein said filler means comprises a honeycomb structure for imparting rigidity to said slat.

11. In a heddle frame assembly as set forth in claim 9, wherein said filler means comprises a foam material.

12. In a heddle frame assembly as set forth in claim 9, wherein said upwardly extending hook portions are hardened and wear resistant.

13. A heddle frame for a weaving machine, comprising:

(a) elongated top and bottom frame slats, each of which comprises: a generally rectangular outer hollow portion extending longitudinally of said frame having front and rear walls spaced by inner and outer pultrusions, said rear and front walls merging at a point inward of said inward pultrusion to form a vertical portion disposed in a vertical plane which extends through the longitudinal axis of said rectangular portion and terminates in a heddle support bar portion, extending from, and along a longitudinal inward edge of said slat, said heddle support bar portion having surfaces for supporting heddles which extend from said heddle bar portion on each side of said vertical plane in planes which intersect each other and said vertical plane at a point between said heddle support surface and the inner most edge of said slat; and side members for maintaining said top and bottom slats in spaced substantially parallel relation to each other with said heddle bar portions disposed along adjacent inward longitudinal edges of said top and bottom slats.

14. A heddle frame as set forth in claim 13, wherein said supporting surfaces are composed of a wear-resistant material.

15. A heddle frame as set forth in claim 13, wherein said front and rear walls are united to form said heddle support bar portion.

16. A heddle frame as set forth in claim 13, wherein said heddle bar support portion comprises a generally T-shaped extruded member integral with said rectangular portion of said slat and has two opposed hardened wear-resistant heddles supporting surfaces disposed on said bar.

17. A heddle frame as set forth in claim 16, wherein said heddle supporting surfaces are formed by a U-shaped wear-resistant hardened element attached to said heddle support bar.

18. A heddle frame set forth in claim 16, wherein said heddle supporting surfaces are hardened wear-resistant material attached to the underside of the cross bar on the T-shaped portion of said heddle support bar.

19. A heddle frame assembly as set forth in claim 16, wherein said heddle support bar is extruded integrally with said rectangular portion of said slat.

20. A heddle frame as set forth in claim 16, wherein said heddle support bar portion is extruded separately from said rectangular portion of said slat and attached to said slat by mechanical means.

21. A heddle frame as set forth in claim 20, wherein said heddle support bar portion is attached to said rectangular portion of said slat by means of rivets.

* * * * *